US006102100A

United States Patent [19]

Perrin et al.

[11] Patent Number: 6,102,100

[45] Date of Patent: Aug. 15, 2000

[54] CONTINUOUS CASTING MOLD FOR METALS

[75] Inventors: Eric Perrin, Metz; Jean-Marc Jolivet, Guenange, both of France

[73] Assignee: Sollac, Puteaux, France

[21] Appl. No.: 09/045,693

[22] Filed: Mar. 23, 1998

[30] Foreign Application Priority Data

Mar. 26, 1997 [FR] France ..... 97 03634

[51] Int. Cl.[7] ..... B22D 11/055

[52] U.S. Cl. ..... 164/443; 164/485

[58] Field of Search ..... 164/443, 485, 164/418, 459

[56] References Cited

U.S. PATENT DOCUMENTS 3,685,571 8/1972 Niskovskikh et al. .
5,020,585 6/1991 Blazek et al. ..... 164/542

FOREIGN PATENT DOCUMENTS 620062 10/1994 European Pat. Off. ..... 164/487
63-171248 7/1988 Japan .
954719 4/1964 United Kingdom .
2017551 10/1979 United Kingdom .

*Primary Examiner*—Kuang Y. Lin
*Attorney, Agent, or Firm*—Nixon Peabody LLP; Thomas W. Cole

[57] ABSTRACT

A continuous casting mold for metals is provided that is formed of an assembly of four metallic plates (13, 14) which plates have channels in their respective interiors. The channels are vertically oriented and serve to pass a fluid which is being circulated for the purpose of cooling. Two or more of said plates (13, 14) each have one or more horizontal channels (6*a,* 6*b*) in the upper part of the plate, which channels serve for circulation of cooling fluid and are independent of the aforesaid vertical channels, wherewith the said vertical channels are terminated at a level below said upper part of the plate.

2 Claims, 2 Drawing Sheets

CONTINUOUS CASTING MOLD FOR METALS

BACKGROUND OF THE INVENTION

The invention relates to the continuous casting of metals, and particular it relates to a bottomless mold having walls which are subjected to intensive cooling, wherewith the solidification of the liquid metal which is cast in a continuous casting machine is begun in the mold.

Known continuous casting molds for steel slab ingot (a product having rectangular cross section and low ratio of thickness to width) are formed of an assembly of four plates comprised of a metal which is a good heat conductor, e.g. copper or a copper alloy. They are intensely cooled by circulating cooling fluid (usually water). The four plates define a casting space into which, when the liquid metal is introduced, the metal begins to solidify at the surfaces of said plates which face the casting space. The cooling water circulates in vertical channels provided in the interior of the plates, with the water flow proceeding from the bottom to the top of the mold.

A disadvantage of this known configuration is that the water never reaches the level of the uppermost regions of the plates. Consequently, these uppermost regions are insufficiently cooled to tolerate being contacted with the liquid metal being solidified. Therefore care must be taken to ensure that the liquid metal surface (the meniscus) in the mold is low enough so that product solidification can begin under suitable conditions without degradation of the mold itself. This renders useless some of the available height of the mold.

This disadvantage is particularly significant when a mold of the general type described is used in an installation of the type designated "semi-continuous casting". In such facilities, a "feeder" enclosure (feeder bush) comprised of a refractory material is mounted immediately above the part of the mold comprised of metal plates which are cooled by the circulating cooling fluid, to provide an extension of the casting space. This "feeder" serves to provide a reserve of liquid metal above the metal part of the mold. The solidification of the product will occur only in the metal part, but the meniscus is raised to a point in the "feeder" structure. This arrangement provides numerous advantages, among which are:

The solidification will begin at a fixed level, namely the upper limit of the metal plates of the mold, and will no longer depend on fluctuations in the level of the meniscus which are unavoidable in classical apparatus;

The end of the conduit through which the steel is introduced to the mold is maintained in the interior of the "feeder" structure, whereby turbulence which tends to occur in connection with the introduction of the steel is afforded time to subside before the steel reaches the upper part of the plates.

These advantages result in a relatively quiescent flow regime of the liquid metal at the level where the solidification begins, which contributes to good quality of the solidified product, in particular good surface regularity. However, in order to benefit fully from the augmented structure employing a "feeder" bush, the cooling capacity in the upper part of the metal plates of the mold must be optimal in order that the solidification begin there in a definitive and concerted manner. As mentioned above, this regularity is not exhibited with plates of the classical type, because the cooling water does not reach the uppermost region of the mold structure formed by said plates. Accordingly, not only is the desired regularity not achieved but the risk of overheating and rapid degradation of the upper region of the plates is enhanced when a mold of the described classical type is used under a refractory "feeder" bush.

SUMMARY OF THE INVENTION

The object of the invention is a continuous casting mold for metal products, which mold has a configuration such that the upper part of the mold has appreciably greater capacity for solidification and cooling of liquid metals, particularly steel, than does the upper part of a mold of the classical type. The inventive mold should be particularly suited for use as the cooled metallic part of a continuous casting apparatus for continuous casting of steel ingot, particularly steel slab ingot.

The principal claimed matter of the invention is a continuous casting mold for metals, of the type comprised of an assembly of four metallic plates which plates have channels in their respective interiors, which channels are vertically oriented and serve to pass a fluid which is being circulated for the purpose of cooling; characterized in that two or more of said plates each have one or more horizontal channels in the upper part of the plate, which channels serve for circulation of cooling fluid and are independent of the aforesaid vertical channels, wherewith the said vertical channels are terminated at a level below said upper part of the plate.

According to a variant of the invention, the mold is a continuous casting mold for steel ingot, comprised of two "large plates" and two "small plates", wherewith at least the "large plates" each have one or more horizontal channels in the upper part of the plate, which channels serve for circulation of cooling fluid and are independent of the aforesaid vertical channels, wherewith the said vertical channels are terminated at a level below said upper part of the plate.

According to the invention, at least two plates of which the mold is comprised (which plates are the "large plates" in the case of a continuous casting mold for ingot) are provided in their upper parts with an independent cooling circuit in which cooling water circulates horizontally. The circulation is carried out generally from the center of the plate toward the lateral sides thereof.

The invention will be better understood with the aid of the following description with reference to the accompanying drawings.

Figure 2:
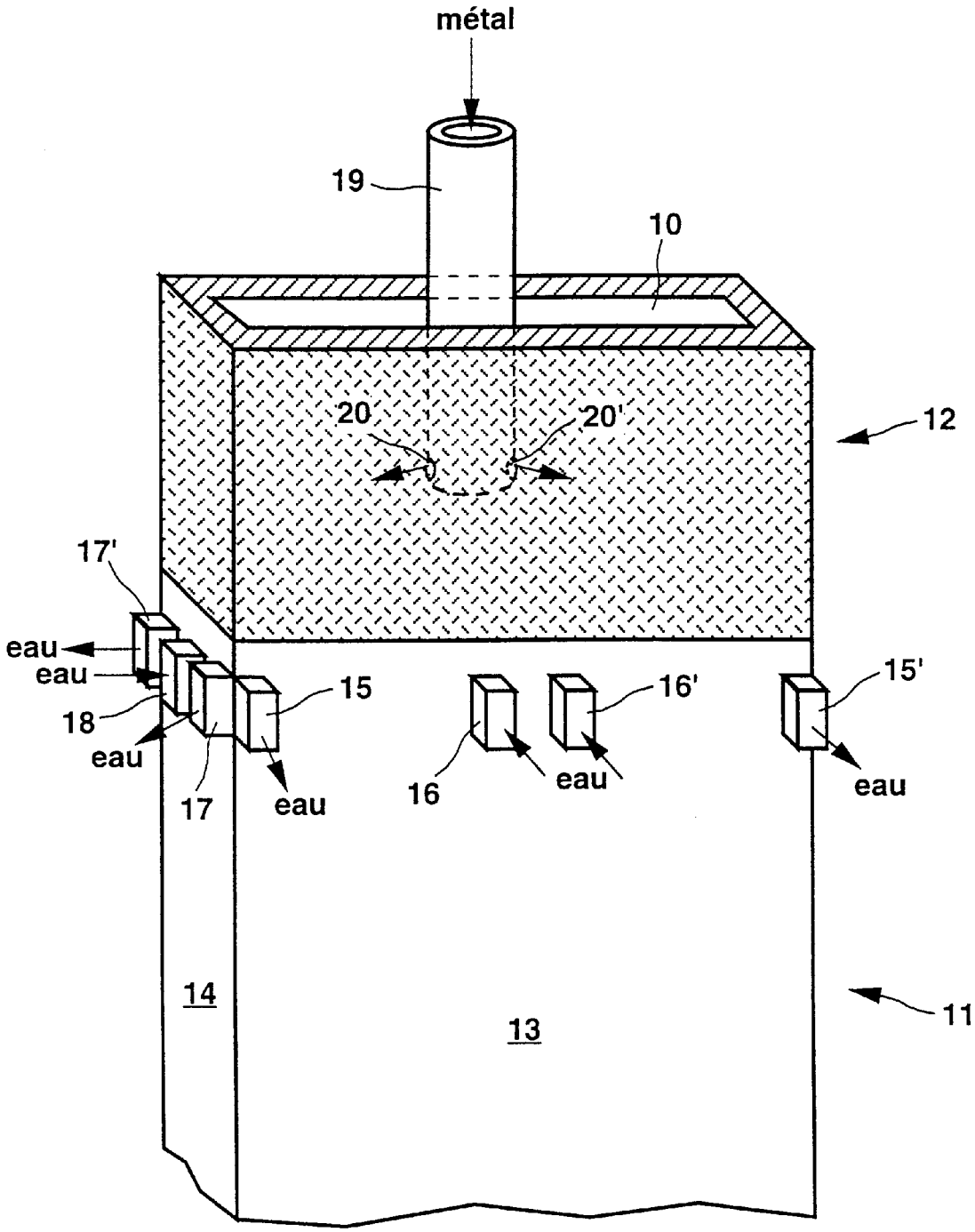
FIG. 2 is a perspective view of a continuous casting mold for casting of ingots, according to the invention.

KEY to FIG. 2: eau=water.

DETAILED DESCRIPTION OF THE PREFERRED EMBODIMENT

Figure 1:
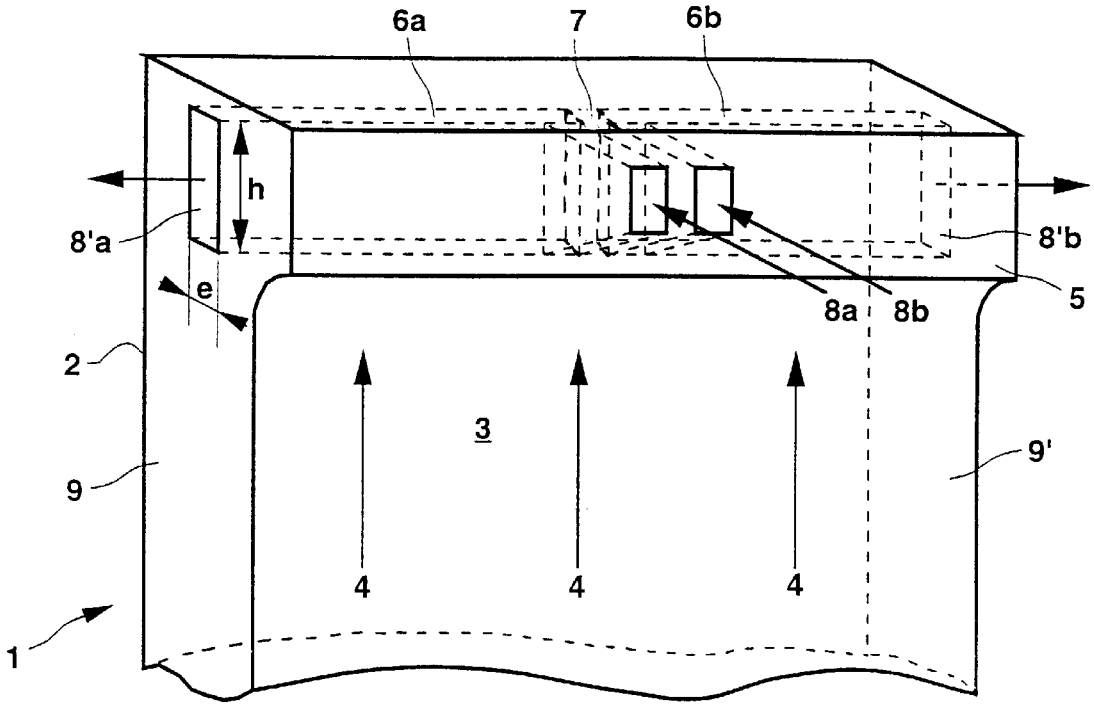
FIG. 1 is a perspective view of an exemplary embodiment of a plate for use in a mold according to the invention.

FIG. 1 shows the upper part of a metal plate 1 comprised of copper or a copper alloy, which plate can be used for one face of a continuous casting mold for steel ingot, according to the invention. The internal surface 2 of plate 1 (facing generally rearward from the vantage point of FIG. 1) is intended to be directed toward the casting space, wherewith surface 2 will contact the liquid metal in order to solidify and cool said metal. The external surface 3 bears vertical grooves or channels (not shown), with cooling water circulating from bottom to top in said grooves or channels as indicated by the arrows (4, 4, 4). Openings for inlet and outlet of the water are provided in a shell (not shown), to allow completion of the water circulation circuit. Alternatively, channels with inlet and outlet openings may be provided within the plate 1.

According to the invention, the vertically oriented water channels are terminated below the upper part of plate 1. The upper part of plate 1 has means which are independent of the said vertically oriented water channels, which means enable circulation of water in a horizontal, not vertical, direction, with the water flowing from the center to the lateral edges of plate 1. In this connection, in the embodiment shown in FIG. 1, the plate 1 has a thickened region 5 in its upper part, which thickened region projects in the forward direction (the direction in which external surface 3 faces). The interior of thickened region 5 bears two horizontal channels (6*a*, 6*b*) which are parallel to the internal surface 2 of plate 1. Channels (6*a*, 6*b*) are juxtaposed and separated by a thin partition 7. Each such channel (6*a*, 6*b*) has an inlet opening (8*a*, 8*b*) for the water, which opening is open to the external surface of the thickened region 5 and is disposed near the midplane between the lateral faces of plate 1; and each channel (6*a*, 6*b*) has a water outlet opening (8'*a*, 8'*b*) which opens out on a respective lateral surface (9, 9') of plate 1. Thus, cooling water circulates horizontally in channels (6*a*, 6*b*) from the center to the edges of plate 1. The provision of independent cooling circuits for each half of plate 1 with flow from the center to the edge ensures symmetry of the cooling intensity in the two halves of the upper part of plate 1.

Alternatively, it is possible to eliminate the partition 7, wherewith the water inlet for the entire upper part of plate 1 is through a single opening disposed at the midplane between the lateral faces of plate 1. This solution may be particularly suitable for the "small plates" which comprise the narrow sides of the mold, with width on the order of 20 cm (as compared to 1–2 m for the "large plates" which comprise the wide sides of the mold), because in the "small plates" there will be little if any problem of asymmetry of distribution of the water or nonuniformity of flow with respect to the midplane of the plate.

Further, in view of the narrowness of the "small plates", it may be practicable to have the cooling fluid flow enter at one of the two extremities (i.e. the two lateral sides) of the plate and exit at the other, rather than being introduced centrally. As a practical matter, in certain cases the amount of heating of the fluid between the inlet and outlet of the "small plate" as the fluid flows from one lateral side to the other of said plate will not be so great as to pose a problem of nonuniformity in the solidification and cooling of the product over the width of the "small plate".

E.g., the height h of the channels may be 40–60 mm, and their width e may be, preferably, not greater than 10 mm. These dimensions will avoid excessive turbulence in the water flow; such turbulence is detrimental to heat transfer between the water and the internal surface 2 of plate 1.

As mentioned, the invention allows intense cooling at the level of the meniscus of the liquid metal present in the mold, even when the meniscus is maintained at a level close to the upper edges of the cooled metal plates 1 of the mold. This allows clearer and more concerted initiation of solidification of the product than with customary molds. Further, if necessary one may effect substantial changes in the heat removal in the region between the center and the lateral sides of the plate 1, and thereby change the gradient of the rate of solidification and cooling between the center and the lateral sides of plate 1, merely by varying the flow rate of the cooling water. In this way, one can make progress toward evening the thickness of the metal solidified at different points along the width of plate 1, if such even thickness is necessary.

The invention may be particularly advantageous in the case of molds for continuous casting of ingots, as illustrated schematically in FIG. 2. The mold shown here is comprised of two superposed parts which define an interior casting space 10 having a rectangular cross section, namely:

a metal part 11 comprised of copper or copper alloy material, which part 11 is assembled from four plates according to the invention, which plates are similar to those described supra and illustrated in FIG. 1; and a part 12 comprised of refractory material, which part is designated the "feeder" and which is in extension of the metal part 11.

The functions of the "feeder" part are described supra in the introductory section of the Specification.

The metal part 11 is fabricated by assembling together two "large plates" (of which only plate 13 is visible in FIG. 2) and two "small plates" (of which only plate 14 is visible in FIG. 2). The large plates are similar to the plate shown in FIG. 1 except that the cooling water outlet openings (15, 15') open out on the external face (front or back face, respectively) of the respective large plate in the immediate neighborhood of the lateral sides of the plate rather than on said sides. Each of the large plates has two water circulation channels, with two distinct water inlet openings (16, 16'). Each of the two small plates 14 in the exemplary embodiment illustrated in FIG. 2 (which of course does not limit the scope of the invention), has only one cooling channel, which extends across the entire width of the plate 14 and has only one water inlet opening 18 disposed in the midplane between the front and back sides of the lateral faces of the metal part 11, but has two water outlet openings (17, 17'). As mentioned, there is little likelihood of maldistribution of the cooling water between the sides of a given small plate, because the small plates are so narrow (c. 20 cm); and in practice the results obtained with the described configuration are quite good.

The lower regions of the plates (13, 14) of metal part 11 of the mold, below the upper regions where the cooling organs described in the preceding paragraph are disposed, are cooled in the conventional manner.

FIG. 2 also shows a conduit 19 comprised of refractory material, whereby liquid metal is supplied to the mold from a tundish or other container (not shown) to which the top of conduit 19 is connected. As is normal practice in continuous casting carried out in semi-continuous fashion, the lower end of the conduit 19 is maintained in the interior of the refractory part 12. In the example illustrated, the metal exits into the casting space from conduit 19 via two diametrically opposed lateral openings (20, 20') at the lower border of the wall of conduit 19, which openings face the two respective small sides of the casting space.

The invention provides the capability for the liquid metal to be cooled rapidly and concertedly after it contacts the metal part 11 of the mold, which is conducive to high surface quality in the cast product. The cooling capability supplied by the invention thus prevents overheating of the upper region of the metal part 11 of the mold.

According to a variant embodiment, in a classical continuous casting mold all of the "large plates" of the mold have horizontal cooling channels in their upper regions, whereas the "small plates" have coolant circulation via vertical channels according to the classical design [for such plates], and do not have any horizontal cooling channels.

This solution is unacceptable for semi-continuous casting, because in such an application it would experience problems of different thermal expansions in different parts of the mold and of the "feeder" part, which would be detrimental to structural stability of the assembly, which assembly needs to be cooled uniformly over its entire perimeter.

The inventive concept can also be adapted to the continuous casting of metal products which have different shapes, dimensions, and/or compositions from the cast products ordinarily classed as slab ingots.

What is claimed:

1. An improved continuous casting mold for steel ingots, of a type including an assembly of a first pair of metallic plates each having a first size and a second pair of metallic plates, each having a second size smaller than said first size and a feeder structure including refractory material mounted on top of said assembly, wherein the plates of said assembly have channels in their respective interiors for circulating a cooling fluid, which channels are vertically oriented but do not extend through an upper portion of said plates, wherein the improvement comprises:

at least one horizontal channel in the upper part of each of the plates, which channel can circulate cooling fluid and is independent of said vertical channels, and wherein said at least one horizontal channel is confined to said upper part and is located along a thickness of its respective plate, wherein at least one of the first plates has two horizontal channels for circulating cooling fluid in said upper part, said horizontal channels being mutually separated by a partition and having respective inlet openings disposed in a region between side faces of the at least one of the first plates and respective outlet openings disposed in the vicinity of said side faces, wherein each second plate comprises a horizontal channel including a single inlet opening disposed in a midplane thereof, and two outlet openings each of which is disposed adjacent one of the sides thereof.

2. An improved continuous casting mold for metals, of a type including an assembly of metallic plates and a feeder structure including refractory material mounted on top of said assembly, which plates have channels in their respective interiors for circulating a cooling fluid, which channels are vertically oriented but do not extend through an upper portion of said plates wherein the improvement comprises:

at least one horizontal channel in said upper part of the plate, which channel can circulate cooling fluid and is independent of said vertical channels, and wherein said at least one horizontal channel is confined to said upper part, and said horizontal channel includes two horizontal channels for circulating cooling fluid in said upper part, said horizontal channels being mutually separated by a partition in said plate and having respective inlet openings disposed in a region on a front face of said plate and respective outlet openings disposed in the vicinity of opposing side faces of said plate.

* * * * *